US007497540B2

(12) United States Patent
Mizutani et al.

(10) Patent No.: US 7,497,540 B2
(45) Date of Patent: Mar. 3, 2009

(54) IMAGE RECORDING APPARATUS, IMAGE RECORDING METHOD, AND IMAGE RECORDING PROGRAM

(75) Inventors: Toshiyuki Mizutani, Hino (JP); Kenichirou Hiramoto, Hachioji (JP)

(73) Assignee: Konica Minolta Holdings Inc., Tokyo (JP)

( * ) Notice: Subject to any disclaimer, the term of this patent is extended or adjusted under 35 U.S.C. 154(b) by 0 days.

(21) Appl. No.: 11/713,501

(22) Filed: Mar. 2, 2007

(65) Prior Publication Data

US 2007/0211100 A1 Sep. 13, 2007

(30) Foreign Application Priority Data

Mar. 10, 2006 (JP) ..... 2006-065676

(51) Int. Cl.
*B41J 2/205* (2006.01)

(52) U.S. Cl. ..... 347/15; 347/12; 347/43

(58) Field of Classification Search ..... 347/15, 347/43, 41, 96, 98, 100, 12, 40
See application file for complete search history.

(56) References Cited

U.S. PATENT DOCUMENTS 6,123,411 A * 9/2000 Inui et al. ..... 347/43
6,158,834 A * 12/2000 Kato et al. ..... 347/9
6,325,502 B1 * 12/2001 Shioya et al. ..... 347/101

FOREIGN PATENT DOCUMENTS

| | | | |
|---|---|---|---|
| JP | 08-072230 | A | 3/1996 |
| JP | 09-272203 | A | 10/1997 |
| JP | 11-334114 | A | 12/1999 |
| JP | 2004-001410 | A | 1/2004 |
| JP | 2005-014223 | A | 1/2005 |
| WO | WO 2004/069543 | A1 | 8/2004 |

* cited by examiner

*Primary Examiner*—Lamson D Nguyen
(74) *Attorney, Agent, or Firm*—Frishauf, Holtz, Goodman & Chick, P.C.

(57) ABSTRACT

An image recording apparatus 1 for recording an image on a recording medium using colored ink and clear ink, including: an ink dot arrangement data generator 10B for generating colored ink dot arrangement data concerning arrangement of dots of the colored ink on the recording medium; a colored ink amount calculator 10C for calculating the amount of colored ink in a predetermined print area composed of pixels from the colored ink dot arrangement data; a clear ink amount calculator 10D for calculating the amount of clear ink in the predetermined print area from the amount of colored ink in the predetermined print area calculated by the colored ink amount calculator 10C; and a clear ink arranger 10E for arranging dots of clear ink in the predetermined print area, wherein, the clear ink arranger has two or more clear ink arrangement order patterns and when a preset condition is realized, selects the clear ink arrangement order pattern according to the condition and arranges dots of clear ink in the predetermined print area.

20 Claims, 6 Drawing Sheets

IMAGE RECORDING APPARATUS, IMAGE RECORDING METHOD, AND IMAGE RECORDING PROGRAM

TECHNICAL FIELD

The present invention relates to an image recording apparatus, an image recording method, and an image recording program.

BACKGROUND

Conventionally, an image processing apparatus for printing by adding transparent ink (hereinafter referred to as clear ink) to colored inks is known. As clear ink, for example, a one for making colored inks unnecessary (for example, Japanese Patent Application Publication No. Hei 8-072230), a one for improving the glossy feeling (for example, Japanese Patent Application Publication No. 2004-001410), and a one for preventing ozone color fading (for example, Japanese Patent Application Publication No. 2005-014223) are known.

And, as a method for deciding the dot arrangement position and amount of the aforementioned clear ink, a method for generating quantized data for clear ink on the basis of the quantized data of colored ink obtained by performing the multilevel halftone process at a rough resolution and arranging dots of clear ink on the basis of the concerned quantized data for clear ink is known (for example, Japanese Patent Application Publication No. Hei 11-334114).

Further, a method for retaining beforehand the dot arrangement pattern of clear ink and on the basis of the dot arrangement pattern of the concerned clear ink, arranging dots of the clear ink is also known (for example, Japanese Patent Application Publication No. Hei 9-272203).

Further, a method for calculating the ink adhesion amount of colored ink in a predetermined print area and on the basis of the ink adhesion amount of the concerned colored ink, deciding the clear ink adhesion amount and arrangement position is also known (for example, WO 2004-069543). The method described in the Patent Document No. Hei 11-334114 has advantages that the burden imposed on the operation is little because the clear ink feed step is simple and the processing speed is fast.

However, the method described in the Patent Document No. Hei 11-334114 performs the half-tone process at a rough resolution, so that a problem arises that the image quality is deteriorated. Further, in the method described in the Patent Document No. Hei 9-272203, in the dot arrangement pattern in a small area, periodicity appears in the clear ink dot arrangement, thus irregularities may be caused, so that it is necessary to retain the dot arrangement pattern in a large area and a problem arises that a large capacity memory is necessary. Further, in the method described in the Patent Document WO 2004-069543, for example, in a solid image in which colored ink is arranged in the same pattern, the clear ink arrangement becomes a fixed pattern, so that irregularities of clear ink may be caused.

An object of the present invention is to provide an image recording apparatus, an image recording method, and an image recording program for preventing an occurrence of irregularities of clear ink, requiring no large capacity memory, and impairing no processing speed.

SUMMARY

It is therefore an object of the present invention to provide an image recording apparatus for recording an image on a recording medium using colored ink of one kind or more and clear ink, including: an ink dot arrangement data generating means for generating colored ink dot arrangement data concerning arrangement of dots of the colored ink on the recording medium; a colored ink amount calculating means for calculating the amount of colored ink in a predetermined print area composed of pixels from the colored ink dot arrangement data; a clear ink amount calculating means for calculating the amount of clear ink in the predetermined print area from the amount of colored ink in the predetermined print area calculated by the colored ink amount calculating means; and a clear ink arranging means for arranging dots of clear ink in the predetermined print area, wherein the clear ink arrangement means has two or more clear ink arrangement order patterns and when a preset condition is realized, selects the clear ink arrangement order pattern according to the condition and arranges dots of clear ink in the predetermined print area.

DESCRIPTION OF THE PREFERRED EMBODIMENT

Figure 1:
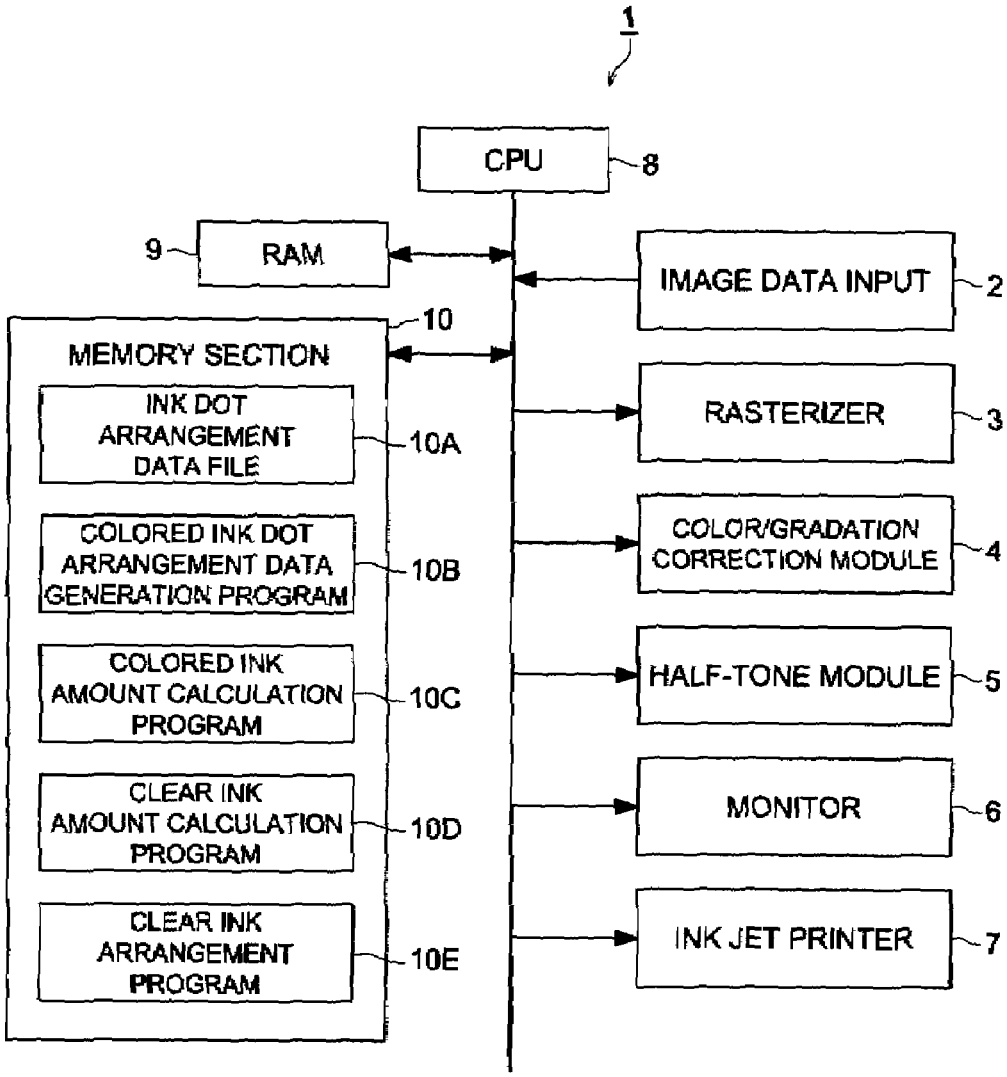
FIG. 1 is a block diagram showing an example of the schematic constitution of the image recording apparatus relating to the first embodiment of the present invention.

According to the invention, for example, when an identified condition for a case that irregularities of clear ink are easily generated is realized, switches to the clear ink arrangement order pattern and can arrange clear ink, thus an occurrence of irregularities of clear ink can be prevented.

Further, the clear ink adhesion amount and arrangement position are calculated for each predetermined print area composed of X×Y pixels, so that the clear ink dot feed step is simplified, thus the burden on the operation can be decreased and the processing speed is not impaired. Further, there is no need to retain the dot arrangement pattern in a large area, so that no large capacity memory is required.

According to the invention, for example, when there is a possibility of an occurrence of irregularities of clear ink, the clear ink arrangement order pattern is switched to and clear ink can be arranged, thus an occurrence of irregularities of clear ink can be prevented preferably.

According to the invention, for example, dots of clear ink are arranged on the basis of the first clear ink arrangement order pattern, thus in correspondence with a case that colored ink and clear ink are not intended to be overlapped, dots of clear ink can be arranged.

According to the invention, for example, dots of clear ink are arranged on the basis of the first clear ink arrangement order pattern, thus in correspondence with a case that colored ink and clear ink are intended to be overlapped, dots of clear ink can be arranged.

According to the invention, for example, dots of clear ink are arranged on the basis of the first clear ink arrangement order pattern, thus the processing speed can be made faster.

According to the invention, the predetermined print area is structured so as to be widened as the print resolution becomes higher, so that, for example, even if the print resolution is not isotropic, actual printing is available in the isotropic area.

According to the invention, for example, the predetermined print area is structured so as to be widened as the dot arrangement resolution of clear ink becomes higher, so that dots of clear ink can be arranged finely, and printing of a higher image quality can be executed.

According to the present invention, when the identified condition for a case that irregularities of clear ink are easily generated is realized, the clear ink arrangement order pattern is switched to and clear ink can be arranged, thus an occurrence of irregularities of clear ink can be prevented preferably.

Further, the clear ink adhesion amount and arrangement position are calculated for each predetermined print area composed of X×Y pixels, so that the clear ink dot feed step is simplified, thus the burden on the operation can be decreased and the processing speed is not impaired. Further, there is no need to retain the dot arrangement pattern in a large area, so that no large capacity memory is required.

Hereinafter, the preferred embodiments of the present invention will be explained in detail with reference to the accompanying drawings. However, the scope of the invention is not limited to the illustrations. Further, although limited expressions may be used, the scope of the invention is not limited to them.

First Embodiment

FIG. 1 is a block diagram showing the schematic constitution of an image recording apparatus 1 to which the present invention is applied. The image recording apparatus 1 relating to the first embodiment, for example, as shown in FIG. 1, is structured so as to include an image data input section 2, a rasterizer 3, a color/gradation correction module 4, a half-tone module 5, a monitor 6, an ink jet printer 7, a CPU (central processing unit) 8, a RAM (random access memory) 9, and a memory section 10. And, the image recording apparatus 1, using colored inks of cyan (C), magenta (M), yellow (Y), and black (K) and clear ink, records an image based on the image data inputted from the image data input section 2 on a recording medium.

The image data input section 2 is a section, for example, connected to an image reading section or a scanner and a personal computer and inputs image data.

The rasterizer 3, for example, on the basis of execution of a colored ink dot arrangement data generation program 10B, which will be described later, by the CPU 8, converts multi-gradation image data inputted from the image data input section 2 from vector data to raster data as necessary.

The color/gradation correction module 4, for example, on the basis of execution of the colored ink dot arrangement data generation program 10B, which will be described later, by the CPU 8, converts the image data converted to raster data by the rasterizer 3 to CMYK data.

The half-tone module 5, for example, on the basis of execution of the colored ink dot arrangement data generation program 10B which will be described later, performs the half-tone process for the image data converted to CMYK data by the color/gradation correction module 4.

The monitor 6 is structured, for example, so as to include a liquid crystal panel and displays the operation status of the image recording apparatus 1.

The ink jet printer 7, for example, when dots of CMYK colored ink and clear ink are arranged on a recording medium, records an image based on the image data image-processed by the image recording apparatus 1 on the recording medium. More concretely, on the basis of the colored ink dot arrangement data and clear ink dot arrangement data which are generated by execution of the colored ink dot arrangement data generation program 10B and a clear ink arrangement program 10E, which will be described later, by the CPU 8, the ink jet printer 7 arranges dot of CMYK colored ink and clear ink on the recording medium.

Here, the print resolution is a one obtained, for example, when the main scanning resolution is 540 dpi and the sub-scanning resolution is 540 dpi.

The CPU 8, for example, reads the processing program stored in the memory section 10 and stores and executes it on the RAM 9, thereby controls the whole image recording apparatus 1.

The RAM 9 stores the processing program executed by the CPU 8 in the program storage area in the RAM 9 and stores processing results obtained when input data and the aforementioned processing program are executed in the data storage area.

The memory section 10 has, for example, a recording medium (not drawn) for storing beforehand a program and data and the recording medium, for example, is composed of a semiconductor memory. Further, the memory section 10 stores various data for realizing the function for controlling the whole image recording apparatus 1 by the CPU 8, various processing programs, and data processed by execution of these programs. More concretely, the memory section 10, for example, as shown in FIG. 1, stores an ink dot arrangement data file 10A, the colored ink dot arrangement data generation program 10B (Ink dot arrangement data generator, ink dot arrangement data generation function), a colored ink amount calculation program 10C (Colored ink amount calculator means, colored ink amount calculation function), a clear ink amount calculation program 10D (Clear ink amount calculator, clear ink amount calculation function), and the clear ink arrangement program 10E (Clear ink arranger, clear ink arrangement function).

Further, the colored ink dot arrangement data generation program 10B, colored ink amount calculation program 10C, clear ink amount calculation program 10D, and clear ink arrangement program 10E function as an image recording program.

The ink dot arrangement data file 10A, for example, stores by making the colored ink dot arrangement data generated by execution of the colored ink dot arrangement data generation program 10B, which will be described later, by the CPU 8, correspond to the clear ink dot arrangement data generated by execution of the clear ink arrangement program 10E by the CPU 8.

The colored ink dot arrangement data generation program 10B is a program, for example, for allowing the CPU 8 to realize a function for controlling the rasterizer 3 and converting the multi-gradation image data inputted from the image data input section 2 as required from vector data to raster data, controlling the color/gradation correction module 4 and converting the image data converted to raster data to CMYK data, and controlling the half-tone module 5 and performing the half-tone process for the image data converted to the CMYK data, thereby generating colored ink dot arrangement data concerning each colored ink dot arrangement of CMYK, and storing the concerned colored ink dot arrangement data in the ink dot arrangement data file 10A. The CPU 8 executes this colored ink dot arrangement data generation program 10B, thereby functions as an ink dot arrangement data generating means.

The colored ink amount calculation program 10C is a program, for example, for allowing the CPU 8 to realize a function for calculating the amount of colored ink in a predetermined print area R composed of X×Y (X and Y are positive integers satisfying X×Y≧2) pixels from the colored ink dot arrangement data stored in the ink dot arrangement data file 10A. Here, X, for example, indicates the number of pixels in the main scanning direction and Y indicates the number of pixels in the sub-scanning direction. The CPU 8 executes the colored ink amount calculation program 10C, thereby functions as a colored ink amount calculating means.

The clear ink amount calculation program 10D is a program, for example, for allowing the CPU 8 to realize a function for calculating the amount of clear ink in the predetermined print area R from the amount of colored ink calculated by execution of the colored ink amount calculation program 10C. The CPU 8 executes this clear ink amount calculation program 10D, thereby functions as a clear ink amount calculating means.

The clear ink arrangement program 10E is a program, for example, for allowing the CPU 8 to realize a function for arranging dots of clear ink in the predetermined print area R. Concretely, the clear ink arrangement program 10E, for example, has two or more clear ink arrangement order patterns and is a program for allowing the CPU 8 to realize a function for switching the concerned clear ink arrangement order pattern when a predetermined identified condition is realized, arranging dots of clear ink in the predetermined print area R, thereby generating clear ink dot arrangement data concerning the dot arrangement of clear ink, and storing the concerned clear ink dot arrangement data in the ink dot arrangement data file 10A.

More concretely, the identified condition, for example, means that dots of clear ink are arranged in the predetermined print area R and the number of pixels for the same amount of the arranged clear ink is M (M is a positive integer satisfying M≧2) or more, and the clear ink arrangement program 10E, for example, has the first clear ink arrangement order pattern and second clear ink arrangement order pattern and is a program for allowing the CPU 8 to realize a function for judging whether dots of clear ink are arranged in the predetermined print area R from the amount of clear ink calculated by execution of the clear ink amount calculation program 10D and the number of pixels for the same amount of the arranged clear ink is M or more or not, when judging that dots of clear ink are arranged and the number of pixels for the same amount of the arranged clear ink is not M or more, arranging dots of clear ink in the pixels G1, G2, G3, and G4 in the predetermined print area R in the order based on the first clear ink arrangement order pattern, and when judging that dots of clear ink are arranged and the number of pixels for the same amount of the arranged clear ink is M or more, arranging dots of clear ink in the pixels G1, G2, G3, and G4 in the predetermined print area R in the order based on the second clear ink arrangement order pattern.

The CPU 8 executes this clear ink arrangement program 10E, thereby functions as a clear ink amount calculating means.

Here, the first clear ink arrangement order pattern is a clear ink arrangement order pattern capable of properly changing the setting, for example, by the clear ink kind. For example, in the case of clear ink giving gloss, the first clear ink arrangement order pattern is a pattern, in the predetermined print area R, for arranging dots of clear ink in the ascending order of amount of the arranged colored ink such as the pixels G1, G2, G3, and G4. Further, in the case of clear ink for preventing bleeding of colored ink and ozone color fading, the first clear ink order pattern is a pattern, in the predetermined print area R, for arranging dots of clear ink in the pixels G1, G2, G3, and G4 in which dots of colored ink are arranged. Further, when a user is not sticky about the print image quality, the first clear ink order pattern is a pattern, in the predetermined print area R, regardless of the amount of the arranged colored ink in each of the pixels G1, G2, G3, and G4, for arranging dots of clear ink in the fixed order.

Further, the second clear ink arrangement order pattern, for example, includes a plurality of arrangement order patterns and is a pattern for selecting one from the plurality of arrangement order patterns on the basis of the order specified by random numbers and arranging dots of clear ink in the predetermined print area R on the basis of the selected arrangement order pattern.

Figure 2:
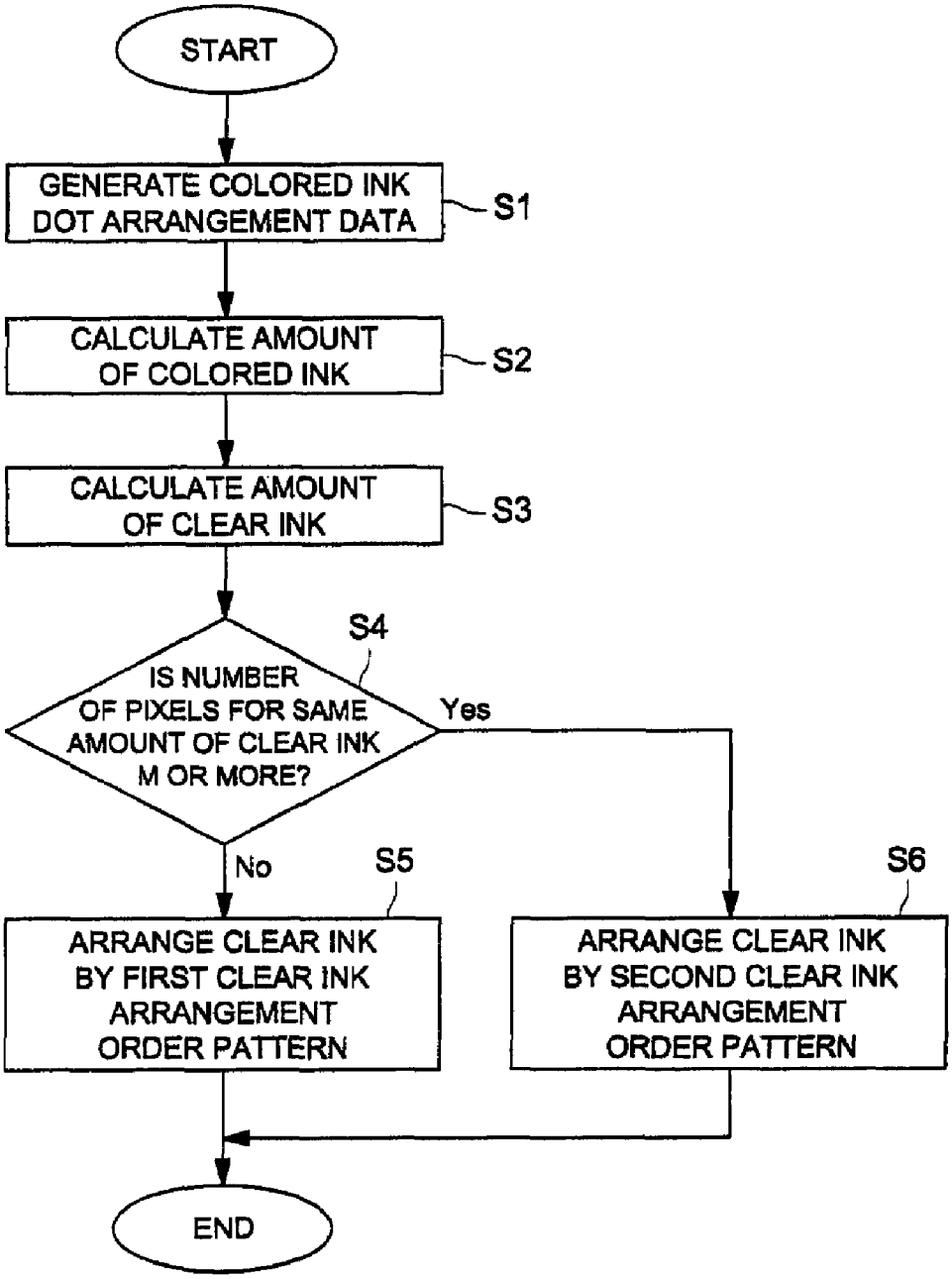
FIG. 2 is a flow chart showing an example of the image recording operation of the image recording apparatus relating to the first embodiment of the present invention.

Next, an example of the image recording operation of the image recording apparatus 1 relating to the first embodiment having the constitution as mentioned above will be explained by referring to the flow chart shown in FIG. 2 and to FIGS. 3 and 4.

Firstly, the CPU 8 executes the colored ink dot arrangement data generation program 10B, thereby generates colored ink dot arrangement data, and stores the colored ink dot arrangement data in the ink dot arrangement data file 10A (Step S1: Ink dot arrangement data generation step).

Next, the CPU 8 executes the colored ink amount calculation program 10C, thereby calculates the amount of colored ink in the predetermined print area R composed of X×Y (X and Y are positive integers satisfying X×Y≧2) pixels from the colored ink dot arrangement data (Step S2: Colored ink amount calculation step).

Figure 3:
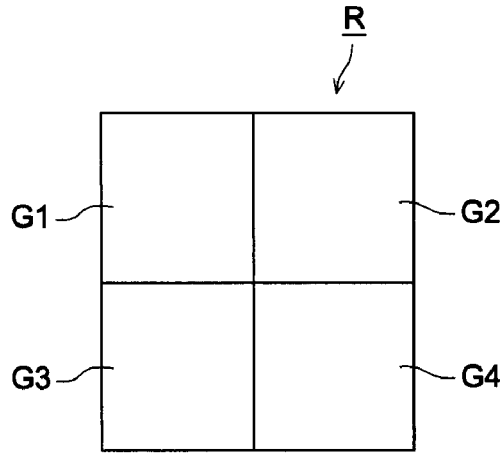
FIG. 3 is a drawing for explaining an example of the image recording operation of the image recording apparatus relating to the embodiments of the present invention.
Figure 3:
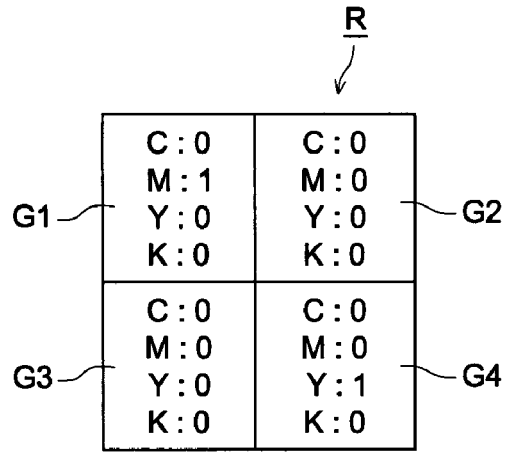
Figure 3:
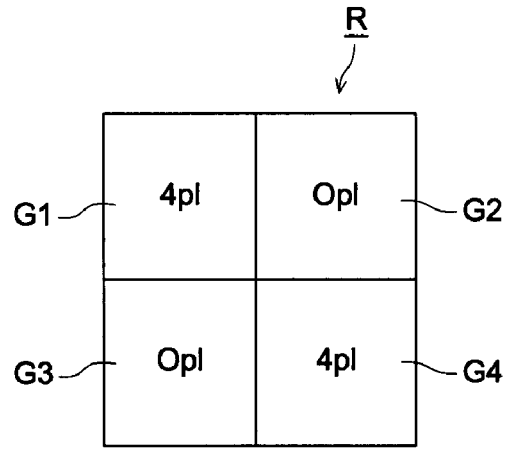

Here, for example, when the predetermined print area R is composed of 2×2 pixels and the ink amount per dot is 4 pi as shown in FIGS. 3(*a*) and 4(*a*) and one dot of M is arranged in the upper left pixel G1 and one dot of Y is arranged in the lower right pixel G4 as shown in FIG. 3(*b*), the CPU 8 executes the colored ink amount calculation program 10C, thereby, for example, as shown in FIG. 3(*c*), judges that colored ink of 4 pi is arranged in the upper left pixel G1 and colored ink of 4 pi is arranged in the lower right pixel G4, and calculates the amount of the arranged colored ink in the predetermined print area R as 8 pi.

Figure 4:
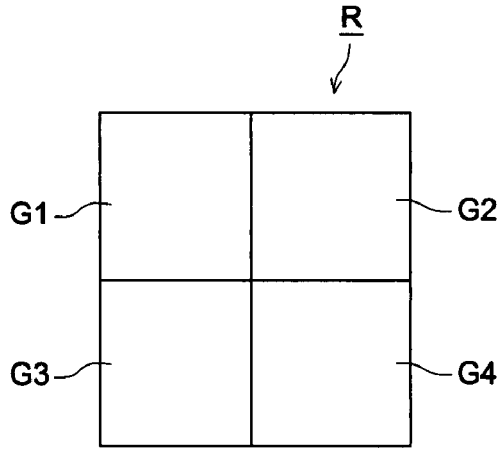
FIG. 4 is a drawing for explaining an example of the image recording operation of the image recording apparatus relating to the embodiments of the present invention.
Figure 4:
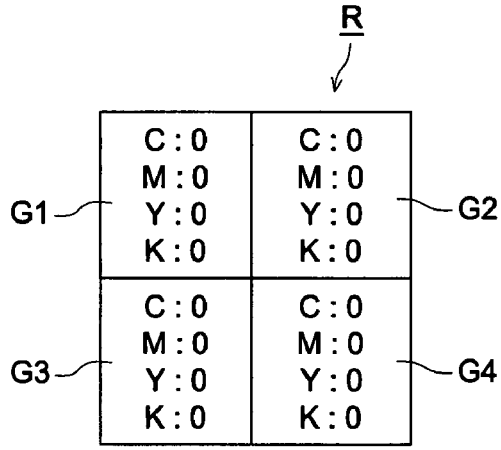
Figure 4:
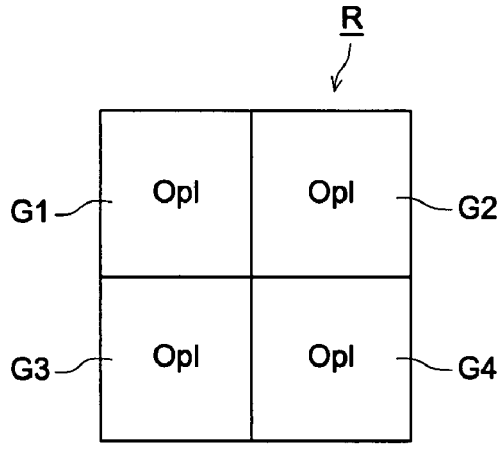

Further, for example, as shown in FIG. 4(*b*), when colored ink is not arranged in all the pixels G1, G2, G3, and G4 in the predetermined print area R, the CPU 8 executes the colored ink amount calculation program 10C, thereby, for example, as shown in FIG. 4(*c*), judges that the amount of the arranged colored ink in all the pixels G1, G2, G3, and G4 is 0 pi and calculates the amount of the arranged colored ink in the predetermined print area R as 0 pi.

Next, the CPU 8 executes the clear ink amount calculation program 10D, thereby calculates the amount of clear ink in the predetermined print area R from the amount of colored ink calculated at Step S2 (Step S3: Clear ink amount calculation step).

Here, for example, when the total ink amount in the print area is decided beforehand as 12 pi, in FIG. 3(*b*), the CPU 8 executes the clear ink amount calculation program 10D, thereby calculates the amount of clear ink in the predetermined print area R as 4 pi.

Further, in FIG. 4(*b*), the CPU 8 executes the clear ink amount calculation program 10D, thereby calculates the amount of clear ink in the predetermined print area R as 12 pi.

Next, the CPU 8 executes the clear ink arrangement program 10E, thereby from the amount of clear ink calculated at Step S3, judges whether dots of clear ink are arranged in the predetermined print area R and the number of pixels for the same amount of the arranged clear ink is M (M is a positive integer satisfying M≧2) or more (Step S4: Clear ink arrangement step).

At Step S4, the CPU 8, when judging that dots of clear ink are arranged in the predetermined print area R and the number of pixels for the same amount of the arranged clear ink is not M or more (No at Step S4), on the basis of the execution of the clear ink arrangement program 10E, arranges dots of clear ink in the pixels G1, G2, G3, and G4 in the predetermined print area R in the order based on the first clear ink arrangement order pattern (Step S5: Clear ink arrangement step).

At Step S4, the CPU 8, when judging that dots of clear ink are arranged in the predetermined print area R and the number of pixels for the same amount of the arranged clear ink is M or more (Yes at Step S4), on the basis of the execution of the clear ink arrangement program 10E, arranges dots of clear ink in the pixels G1, G2, G3, and G4 in the predetermined print area R in the order based on the second clear ink arrangement order pattern (Step S6: Clear ink arrangement step).

Here, for example, in FIG. 3(*b*), the amount of clear ink calculated at Step S3 is 4 pi, so that the clear ink arranged in the predetermined print area R is 1 dot. Therefore, in FIG. 3(*b*), the CPU 8 executes the clear ink arrangement program 10E at Step S4, thereby judges that dots of clear ink are arranged in the predetermined print area R and the number of pixels for the same amount of the arranged clear ink is 1, and judges that dots of clear ink are arranged in the predetermined print area R and the number of pixels for the same amount of the arranged clear ink is not M or more.

And, at Step S5, the CPU 8, on the basis of the execution of the clear ink arrangement program 10E and in the order based on the first clear ink arrangement order pattern, arranges dots of clear ink. Here, when the first clear ink arrangement order pattern is a pattern, in the predetermined print area R, for arranging dots of clear ink in the ascending order of amount of the arranged colored ink such as the pixels G1, G2, G3, and G4, in FIG. 3, dots of clear ink are arranged in either of the upper right pixel G2 and lower left pixel G3 in the predetermined print area R. In this case, the order of priority of the pixels G1, G2, G3, and G4 in the predetermined print area R is decided beforehand, and on the basis of the concerned order of priority, in which one of the pixels G1, G2, G3, and G4 dots of clear ink are to be arranged is decided. For example, as shown in FIG. 3(*a*), with respect to the order of priority in the predetermined print area R, assuming the upper left pixel G1 as 1, the upper right pixel G2 as 2, the lower left pixel G3 as 3, and the lower right pixel G4 as 4, in FIG. 3, one dot of clear ink is arranged in the upper right pixel G2.

Further, for example, in FIG. 4(*b*), the amount of clear ink calculated at Step S3 is 12 pi, so that the clear ink arranged in the predetermined print area R is 3 dots and when the concerned 3 dots are arranged in the ascending order of amount of the arranged colored ink such as the pixels G1, G2, G3, and G4 (in the order based on the first clear ink arrangement order pattern), one dot is arranged in each of the three pixels G1, G2, and G3. Therefore, in FIG. 4(*b*), the CPU 8 executes the clear ink arrangement program 10E at Step S4, thereby judges that dots of clear ink are arranged in the predetermined print area R and the number of pixels for the same amount of the arranged clear ink is 3, and judges that dots of clear ink are arranged in the predetermined print area R and the number of pixels for the same amount of the arranged clear ink is M or more.

And, at Step S6, the CPU 8, on the basis of the execution of the clear ink arrangement program 10E and in the order based on the second clear ink arrangement order pattern, arranges dots of clear ink. Here, in FIG. 4, in the predetermined print area R, assuming the upper left pixel G1 as A, the upper right pixel G2 as B, the lower left pixel G3 as C, and the lower right pixel G4 as D and assuming that as a second clear ink arrangement order pattern, for example, the following plurality of arrangement order patterns are stored:

Pattern 1: A→B→C→D,
Pattern 2: B→D→A→C,
Pattern 3: C→D→A→B, and
Pattern 4: D→B→C→A, the CPU 8, on the basis of the order specified by random numbers, selects one arrangement order pattern from the plurality of arrangement order patterns of Patterns 1 to 4, and in the order based on the selected arrangement order pattern, arranges dots of clear ink. For example, in FIG. 4(*b*), assuming that the CPU 8 selects the arrangement order pattern of Pattern 3, one dot of clear ink is arranged in each of the lower left pixel G3, lower right pixel G4, and upper left pixel G1.

Further, as a second clear ink arrangement order pattern, in FIG. 4, 24 arrangement order patterns may be considered, though it is not always necessary to store all the arrangement order patterns.

According to the image recording apparatus 1, image recording method, and image recording program relating to the first embodiment explained above, in the image recording apparatus 1 for recording an image on a recording medium using colored ink of one kind or more and clear ink, by execution of the colored ink dot arrangement data generation program 10B by the CPU 8, colored ink dot arrangement data concerning arrangement of dots of the colored ink on the recording medium is generated, and by execution of the colored ink amount calculation program 10C by the CPU 8, the amount of colored ink in the predetermined print area R composed of X×Y (X and Y are positive integers satisfying X×Y≧2) pixels is calculated from the colored ink dot arrangement data, and by execution of the clear ink amount calculating program 10D by the CPU 8, the amount of clear ink in the predetermined print area R is calculated from the amount of colored ink in the predetermined print area R calculated by execution of the colored ink amount calculating program 10C, and by execution of the clear ink arrangement program 10E by the CPU 8, dots of clear ink are arranged in the predetermined print area R, and the CPU 8 executes the clear ink arrangement program 10E, thereby has two or more clear ink arrangement order patterns, when a preset identified condition is realized, switches the clear ink arrangement order pattern, and arranges dots of clear ink in the predetermined print area R, so that, for example, when a preset identified condition for a case that irregularities of clear ink are easily generated is realized, switches to the clear ink arrangement order pattern for preventing an occurrence of irregularities and can arrange clear ink, thereby can prevent an occurrence of irregularities of clear ink.

Further, the clear ink adhesion amount and arrangement position are calculated for each predetermined print area R composed of X×Y pixels, so that the clear ink dot feed step is simplified, thus the burden on the operation can be decreased and the processing speed is not impaired. Further, there is no need to retain the dot arrangement pattern in a large area, so that no large capacity memory is required.

Further, the identified condition is that dots of clear ink are arranged in the predetermined print area R and the number of pixels for the same amount of the arranged clear ink is M (M is a positive integer satisfying M≧2) or more, so that when there is a possibility of an occurrence of irregularities of clear ink, for example, the clear ink arrangement order pattern for preventing an occurrence of irregularities is switched to and clear ink can be arranged, thus an occurrence of irregularities of clear ink can be prevented preferably.

Further, the clear ink arrangement order pattern includes the first clear ink arrangement order pattern and second clear ink arrangement order pattern, and the first clear ink arrangement order pattern is a pattern, in the predetermined print area R, for arranging dots of clear ink in the ascending order of amount of the arranged colored ink such as the pixels G1, G2, G3, and G4, so that dots of clear ink are arranged on the basis of the first clear ink arrangement order pattern, thus in correspondence with the case that colored ink and clear ink are not intended to be overlapped, dots of clear ink can be arranged.

Further, the clear ink arrangement order pattern includes the first clear ink arrangement order pattern and second clear ink arrangement order pattern, and the first clear ink arrangement order pattern is a pattern, in the predetermined print area R, for arranging dots of clear ink in the pixels G1, G2, G3, and G4 in which dots of colored ink are arranged, so that dots of clear ink are arranged on the basis of the first clear ink arrangement order pattern, thus in correspondence with the case that colored ink and clear ink are intended to be overlapped, dots of clear ink can be arranged.

Further, the clear ink arrangement order pattern includes the first clear ink arrangement order pattern and second clear ink arrangement order pattern, and the first clear ink arrangement order pattern is a pattern, in the predetermined print area R, for arranging dots of clear ink in the fixed order regardless of the amount of the colored ink arranged in the pixels G1, G2, G3, and G4, so that dots of clear ink are arranged on the basis of the first clear ink arrangement order pattern, thus the processing speed can be made faster.

Further, the clear ink arrangement order pattern includes the first clear ink arrangement order pattern and second clear ink arrangement order pattern, and the second clear ink arrangement order pattern includes a plurality of arrangement order patterns, and the CPU 8 executes the clear ink arrangement program 10E, thereby, when the identified condition is realized, switches to the second clear ink arrangement order pattern, selects one from the plurality of arrangement order patterns on the basis of the order specified by random numbers, and arranges dots of clear ink in the predetermined print area R on the basis of the selected arrangement order pattern, so that whenever the identified condition is realized, a different arrangement order pattern is selected according to the order specified by the random numbers, and dots of clear ink are arranged on the basis of the concerned arrangement order pattern, so that, for example, when there is a possibility of an occurrence of irregularities of clear ink, clear ink is arranged on the basis of the second clear ink arrangement patter, thus irregularities of clear ink can be prevented more preferably.

Further, in the process at Step S6, as a second clear ink arrangement order pattern, a plurality of arrangement order patterns are selected in the order specified by random numbers, and in the order based on the selected arrangement order pattern, dots of clear ink are arranged. However, the second clear ink arrangement order pattern is not limited to it and for example, it is possible to assign numeric addresses to the pixels G1, G2, G3, and G4 in the predetermined print area R using random numbers and arrange dots of clear ink in the ascending order of numerals.

Further, in this embodiment, the total ink amount in the predetermined print area R is decided beforehand, and the CPU 8 executes the clear ink amount calculation program 10D, thus the amount of clear ink is calculated from the total ink amount and the amount of colored ink in the predetermined print area R. However, the amount of clear ink may be calculated by another method. For example, a correlative function between the colored ink amount and the clear ink amount is decided beforehand, and the CPU 8 executes the clear ink amount calculation program 10D, thus the amount of clear ink may be calculated from the concerned correlative function and the amount of colored ink. By use of such a constitution, the correlative function is set properly, thus the amount of clear ink can be at a higher degree of freedom.

Second Embodiment

Figure 5:
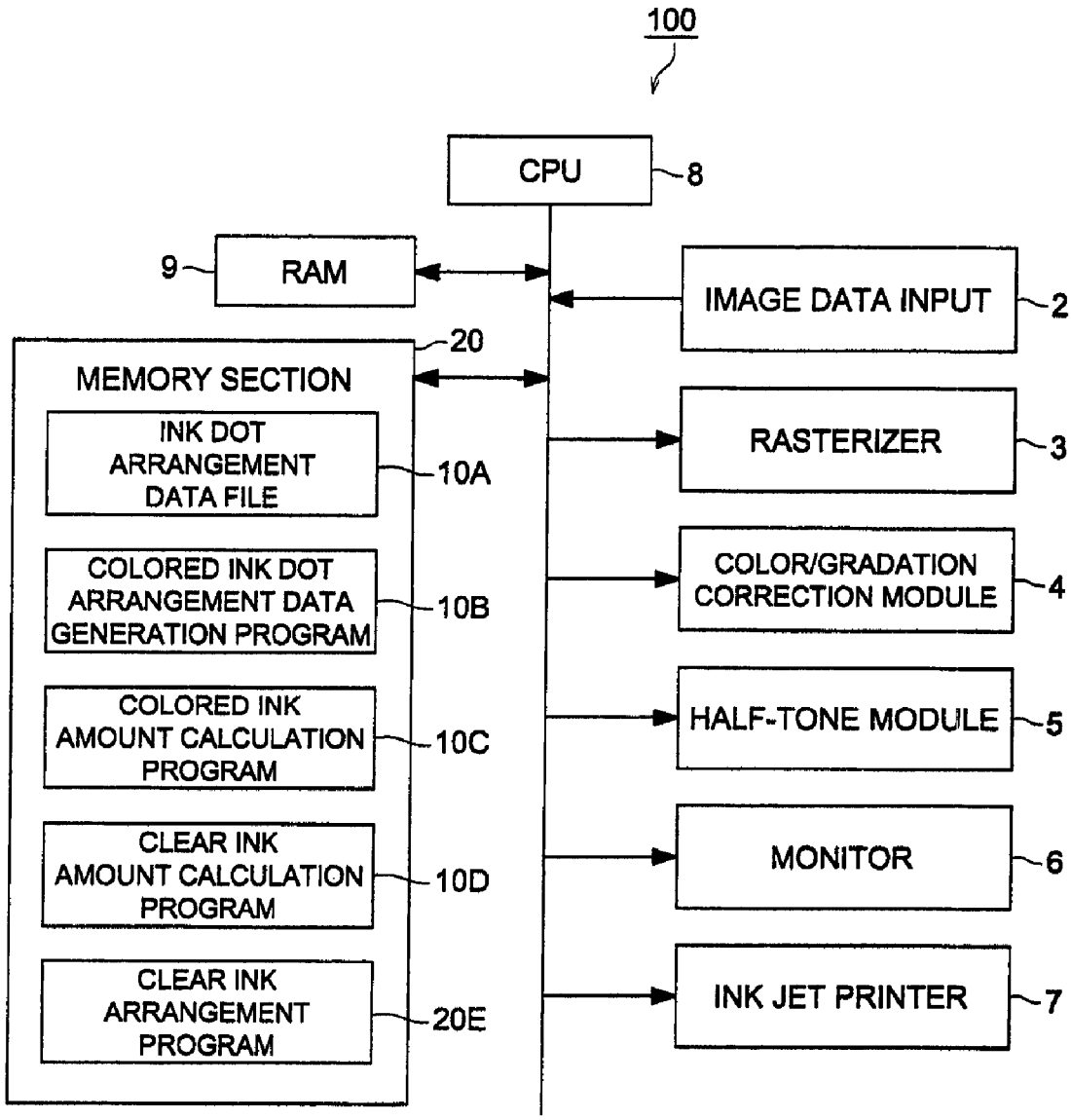
FIG. 5 is a block diagram showing an example of the schematic constitution of the image recording apparatus relating to the second embodiment of the present invention.

In an image recording apparatus 100 relating to the second embodiment, for example, as shown in FIG. 5, only the constitution of a memory section 20 is different from that of the image recording apparatus 1 relating to the first embodiment, so that the same numerals are assigned to the other components and the explanation thereof will be omitted.

The memory section 20, for example, has a recording medium (not drawn) for storing beforehand programs and data, which is, for example, composed of a semiconductor memory. Further, the memory section 20 stores various data and various processing programs for realizing the function for controlling the whole image recording apparatus 100 by the CPU 8 and data processed by execution of the programs. More concretely, the memory section 20, for example, as shown in FIG. 5, stores the ink dot arrangement data file 10A, colored ink dot arrangement data generation program 10B, colored ink amount calculation program 10C, clear ink amount calculation program 10D, and clear ink arrangement program 20E.

Further, the colored ink dot arrangement data generation program 10B, colored ink amount calculation program 10C, clear ink amount calculation program 10D, and clear ink arrangement program 20E function as an image recording program.

The clear ink arrangement program 20E is a program, for example, for allowing the CPU 8 to realize a function for arranging dots of clear ink in the predetermined print area R. Concretely, the clear ink arrangement program 20E, for example, has two or more clear ink arrangement order patterns and is a program for allowing the CPU 8 to realize a function for switching the concerned clear ink arrangement order pattern when a predetermined identified condition is realized and arranging dots of clear ink in the predetermined print area R.

More concretely, the identified condition is, for example, that the predetermined print area R for the same amount of the arranged clear ink is continued N (N is a positive integer satisfying N>1) times or more, and the clear ink arrangement program 20E, for example, has the first clear ink arrangement order pattern and second clear ink arrangement order pattern and is a program for allowing the CPU 8 to realize a function for judging whether the predetermined print area R for the same amount of clear ink calculated by execution of the clear ink amount calculation program 10D is continued N or more times or not, and when judging that the predetermined print area R for the same amount of clear ink is not continued N or more times, arranging dots of clear ink in the pixels G1, G2, G3, and G4 in the predetermined print area R in the order based on the first clear ink arrangement order pattern, and when judging that the predetermined print area R for the same amount of clear ink is continued N or more times, arranging dots of clear ink in the pixels G1, G2, G3, and G4 in the predetermined print area R in the order based on the second clear ink arrangement order pattern.

The CPU 8 executes this clear ink arrangement program 20E, thereby functions as a clear ink amount calculating means.

Here, the first clear ink arrangement order pattern, for example, is a pattern for arranging dots of clear ink in the order specified by a dither pattern corresponding to the predetermined print area R.

Further, the second clear ink arrangement order pattern, for example, has a plurality of dither patterns corresponding to the predetermined print area R and is a pattern for selecting one from the plurality of dither patterns on the basis of the order specified by random numbers and arranging dots of clear ink in the predetermined print area R on the basis of the selected dither pattern.

Figure 6:
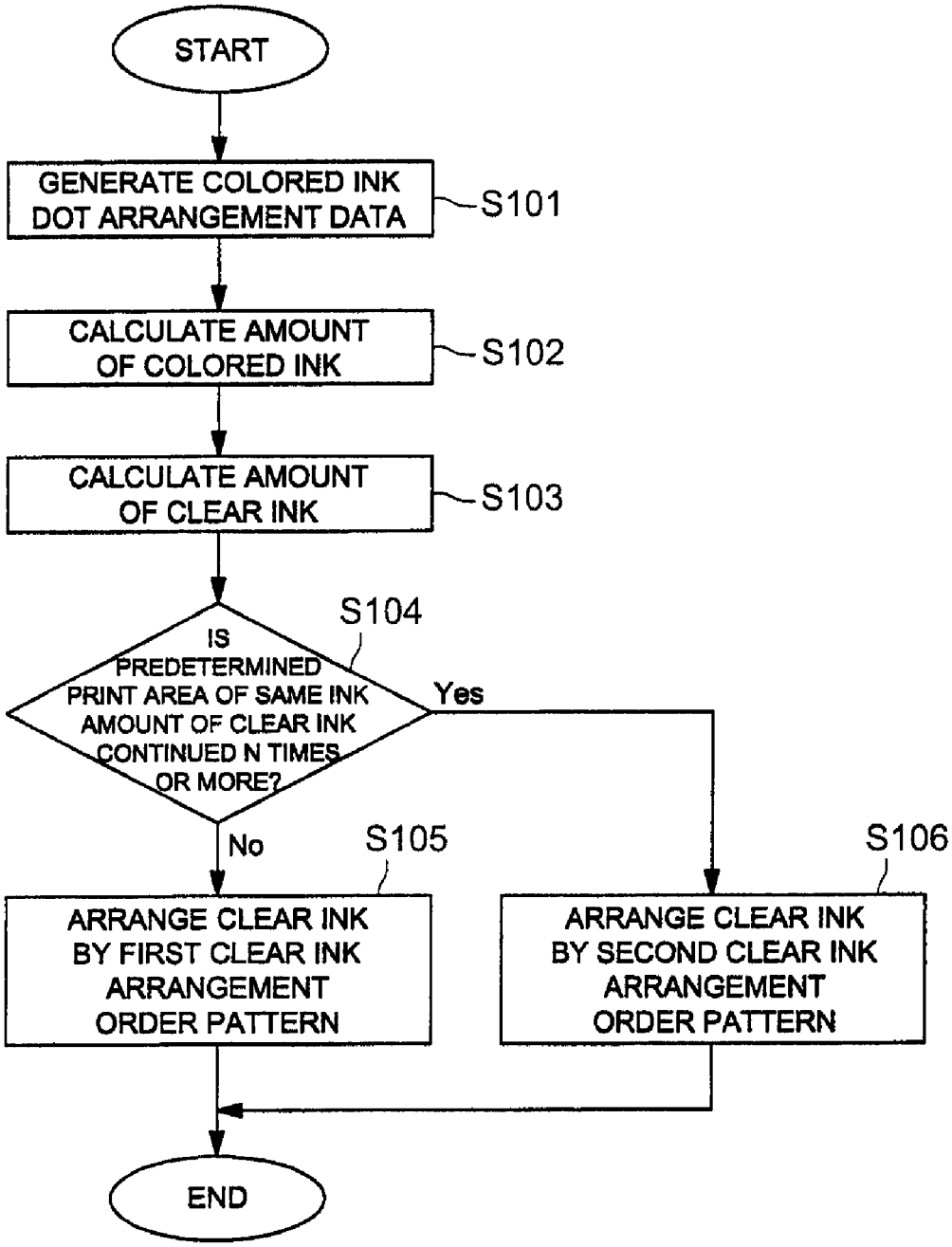
FIG. 6 is a flow chart showing an example of the image recording operation of the image recording apparatus relating to the second embodiment of the present invention.

Next, an example of the image recording operation of the image recording apparatus 100 relating to the second embodiment having the constitution as mentioned above will be explained by referring to the flow chart shown in FIG. 6.

Firstly, the CPU 8 executes the colored ink dot arrangement data generation program 10B, thereby generates colored ink dot arrangement data, and stores the colored ink dot arrangement data in the ink dot arrangement data file 10A (Step S101: Ink dot arrangement data generation step)

Next, the CPU 8 executes the colored ink amount calculation program 10C, thereby calculates the amount of colored ink in the predetermined print area R composed of X×Y (X and Y are positive integers satisfying X×Y≧2) pixels from the colored ink dot arrangement data (Step S102: Colored ink amount calculation step).

Next, the CPU 8 executes the clear ink amount calculation program 10D, thereby calculates the amount of clear ink in the predetermined print area R from the amount of colored ink calculated at Step S102 (Step S103: Clear ink amount calculation step).

Next, the CPU 8 executes the clear ink arrangement program 20E, thereby judges whether the predetermined print area R for the same amount of clear ink calculated at Step S103 is continued N (N is a positive integer satisfying N>1) times or more or not (Step S104: Clear ink arrangement step).

At Step S104, the CPU 8, when judging that the predetermined print area R for the same amount of clear ink is not continued N or more times (No at Step S104), on the basis of the execution of the clear ink arrangement program 20E, arranges dots of clear ink in the pixels G1, G2, G3, and G4 in the predetermined print area R in the order based on the first clear ink arrangement order pattern (Step S105: Clear ink arrangement step).

At Step S104, the CPU 8, when judging that the predetermined print area R for the same amount of clear ink is continued N or more times (Yes at Step S104), on the basis of the execution of the clear ink arrangement program 20E, arranges dots of clear ink in the pixels G1, G2, G3, and G4 in the predetermined print area R in the order based on the second clear ink arrangement order pattern (Step S106: Clear ink arrangement step).

According to the image recording apparatus 100, image recording method, and image recording program relating to the second embodiment explained above, needless to say, the same effects as those of the image recording apparatus 1, image recording method, and image recording program relating to the first embodiment are obtained, and particularly, the identified condition is that the predetermined print area R for the same amount of clear ink is continued N (N is a positive integer satisfying N>1) times or more, so that when there is a possibility of an occurrence of irregularities of clear ink, for example, the clear ink arrangement order pattern for preventing an occurrence of irregularities is switched to and clear ink can be arranged, thus an occurrence of irregularities of clear ink can be prevented preferably.

Further, the predetermined print area R may be structured so as to be widened as the print resolution becomes higher. Concretely, in the embodiment aforementioned, with respect to the print resolution, when the main scanning resolution is 540 dpi and the sub-scanning resolution is 540 dpi, the predetermined print area R is defined as 2×2 pixels. However, for example, when the main scanning resolution is 1080 dpi and the sub-scanning resolution is 540 dpi, the predetermined print area R may be defined as 4×2 pixels. By use of such a constitution, the predetermined print area R is widened as the print resolution becomes higher, so that, for example, even if the print resolution is not isotropic, actual printing is available in the isotropic area.

Further, the predetermined print area R may be structured so as to be widened as the dot arrangement resolution of clear ink becomes higher. By use of such a constitution, the predetermined print area R is widened as the dot arrangement resolution of clear ink becomes higher, so that dots of clear ink can be arranged finely, and printing of a higher image quality can be executed.

Further, the present invention can be applied, for example, also to a case that dots of a plurality of sizes such as large dots, medium dots, and small dots are arranged. For example, when large dots are 20 pi, and medium dots are 7 pi, and small dots are 4 pi, it is only necessary to count dots for each dot size and calculate the ink amount. Similarly, when dots of shading ink are arranged, it is only necessary to individually count dots of ordinary colored ink and dots of shading ink, thereby calculate the ink amount.

Further, when using clear ink giving gloss and calculating the amount of colored ink, for example, a constitution of counting no dots of colored ink with low glossiness such as black (K) may be used. By use of such a constitution, gloss can be supplemented for colored ink with low glossiness.

Further, when using clear ink for preventing bleeding of colored ink and ozone color fading, it is allowed to arrange dots of clear ink starting from the dot position of colored ink with low preservation property in priority. By use of such a constitution, colored ink with low preservation property can be protected more efficiently by clear ink.

What is claimed is:

1. An image recording apparatus for recording an image on a recording medium using colored ink and clear ink, comprising:

an ink dot arrangement data generator for generating colored ink dot arrangement data concerning arrangement of dots of the colored ink on the recording medium;

a colored ink amount calculator for calculating an amount of the colored ink in a predetermined print area composed of X×Y pixels from the colored ink dot arrangement data, where X and Y are positive integers satisfying X×Y≧2;

a clear ink amount calculator for calculating an amount of the clear ink in the predetermined print area from the amount of the colored ink in the predetermined print area calculated by the colored ink amount calculator; and a clear ink arranger for arranging dots of the clear ink in the predetermined print area, wherein the clear ink arranger comprises a plurality of clear ink arrangement order patterns, and when a preset condition is realized, the clear ink arranger selects one of the clear ink arrangement order patterns according to the preset condition and arranges the dots of the clear ink in the predetermined print area.

2. The image recording apparatus of claim 1, wherein the preset condition is that the dots of the clear ink are arranged in the predetermined print area and that a number of pixels for the amount of the clear ink is at least M, where M is a positive integer satisfying M≧2.

3. The image recording apparatus of claim 1, wherein the preset condition is that the predetermined print area for the amount of the clear ink is repeated continuously at least N times, where N is a positive integer satisfying N>1.

4. The image recording apparatus of claim 1, wherein the plurality of clear ink arrangement order patterns include a first clear ink arrangement order pattern and a second clear ink arrangement order pattern, and wherein the first clear ink arrangement order pattern is a pattern, in the predetermined print area, for arranging the dots of the clear ink in an ascending order of an amount of the arranged colored ink in each pixel.

5. The image recording apparatus of claim 1, wherein the plurality of clear ink arrangement order patterns include a first clear ink arrangement order pattern and a second clear ink arrangement order pattern, and wherein the first clear ink arrangement order pattern is a pattern, in the predetermined print area, for arranging the dots of the clear ink in pixels in which dots of the colored ink are arranged.

6. The image recording apparatus of claim 1, wherein the plurality of clear ink arrangement order patterns include a first clear ink arrangement order pattern and a second clear ink arrangement order pattern, and wherein the first clear ink arrangement order pattern is a pattern, in the predetermined print area, for arranging the dots of the clear ink in a fixed order regardless of an amount of the colored ink arranged in each pixel.

7. The image recording apparatus of claim 1, wherein the plurality of clear ink arrangement order patterns include a first clear ink arrangement order pattern and a second clear ink arrangement order pattern, and the second clear ink arrangement order pattern includes a plurality of arrangement order patterns, and wherein, when the preset condition is realized, the clear ink arranger switches to the second clear ink arrangement order pattern, selects one of the plurality of arrangement order patterns based on an order specified by random numbers, and arranges the dots of the clear ink in the predetermined print area based on the selected arrangement order pattern.

8. The image recording apparatus of claim 1, wherein the predetermined print area is wider as a print resolution becomes higher.

9. The image recording apparatus of claim 1, wherein the predetermined print area is wider as a resolution of dot arrangement of the clear ink becomes higher.

10. An image recording method for recording an image on a recording medium using colored ink and clear ink, comprising:

generating colored ink dot arrangement data concerning arrangement of dots of the colored ink on the recording medium;

calculating an amount of the colored ink in a predetermined print area composed of X×Y pixels from the colored ink dot arrangement data, where X and Y are positive integers satisfying X×Y≧2;

calculating an amount of the clear ink in the predetermined print area from the calculated amount of the colored ink in the predetermined print area; and arranging dots of the clear ink in the predetermined print area by selecting a clear ink arrangement order pattern from a plurality of clear ink arrangement order patterns when a preset condition is realized, and arranging the dots of the clear ink in the predetermined print area accordingly.

11. The image recording method of claim 10, wherein the preset condition is that the dots of the clear ink are arranged in the predetermined print area and that a number of pixels for the amount of the clear ink is at least M, where M is a positive integer satisfying M≧2.

12. The image recording method of claim 10, wherein the preset condition is that the predetermined print area for the amount of the clear ink is repeated continuously N times, where N is a positive integer satisfying N>1.

13. The image recording method of claim 10, wherein the plurality of clear ink arrangement order patterns include a first clear ink arrangement order pattern and a second clear ink arrangement order pattern, and wherein the first clear ink arrangement order pattern is a pattern, in the predetermined print area, for arranging the dots of the clear ink in an ascending order of an amount of the arranged colored ink in each pixel.

14. The image recording method of claim 10, wherein the plurality of clear ink arrangement order patterns include a first clear ink arrangement order pattern and a second clear ink arrangement order pattern, and wherein the first clear ink arrangement order pattern is a pattern, in the predetermined print area, for arranging the dots of the clear ink in pixels in which dots of the colored ink are arranged.

15. The image recording method of claim 10, wherein the plurality of clear ink arrangement order patterns include a first clear ink arrangement order pattern and a second clear ink arrangement order pattern, and wherein the first clear ink arrangement order pattern is a pattern, in the predetermined print area, for arranging the dots of the clear ink in a fixed order regardless of an amount of the colored ink arranged in each pixel.

16. The image recording method of claim 10, wherein the plurality of clear ink arrangement order patterns include a first clear ink arrangement order pattern and a second clear ink arrangement order pattern, and the second clear ink arrangement order pattern includes a plurality of arrangement order patterns, and wherein, when the preset condition is realized, the arranging of the dots of the clear ink in the predetermined print area is conducted by switching to the second clear ink arrangement order pattern, selecting one of the plurality of arrangement order patterns based on an order specified by random numbers, and arranging the dots of the clear ink in the predetermined print area based on the selected arrangement order pattern.

17. The image recording method of claim 10, wherein the predetermined print area is wider as a print resolution becomes higher.

18. The image recording method of claim 10, wherein the predetermined print area is wider as a resolution of dot arrangement of the clear ink becomes higher.

19. A computer readable medium having stored thereon an image recording program to control a computer to function as an image recording apparatus for recording an image on a recording medium using colored ink and clear ink, the image recording program causing the image recording apparatus to perform functions comprising:

generating colored ink dot arrangement data concerning arrangement of dots of the colored ink on the recording medium;

calculating an amount of the colored ink in a predetermined print area composed of X×Y pixels from the colored ink dot arrangement data, where X and Y are positive integers satisfying $X \times Y \geqq 2$;

calculating an amount of the clear ink in the predetermined print area from the calculated amount of the colored ink in the predetermined print area; and arranging dots of the clear ink in the predetermined print area by selecting a clear ink arrangement order pattern from a plurality of clear ink arrangement order patterns when a preset condition is realized, and arranging the dots of the clear ink in the predetermined print area accordingly.

20. An image recording apparatus for recording an image on a recording medium using colored ink and clear ink, comprising:

an ink dot arrangement data generator for generating colored ink dot arrangement data concerning arrangement of dots of the colored ink on the recording medium;

a colored ink amount calculator for calculating an amount of the colored ink in a predetermined print area composed of X×Y pixels from the colored ink dot arrangement data, where X and Y are positive integers satisfying $X \times Y \geqq 2$;

a clear ink amount calculator for calculating an amount of the clear ink in the predetermined print area from the amount of the colored ink in the predetermined print area calculated by the colored ink amount calculator; and a clear ink arranger for arranging dots of the clear ink in the predetermined print area;

wherein the clear ink arranger comprises a plurality of clear ink arrangement order patterns, and when a preset condition is realized, the clear ink arranger selects a clear ink arrangement order pattern according to the preset condition and arranges the dots of the clear ink in the predetermined print area;

wherein the preset condition is that the dots of the clear ink are arranged in the predetermined print area and that a number of pixels for the amount of the clear ink is at least M, where M is a positive integer satisfying $M \geqq 2$; and wherein the preset condition is that the predetermined print area for the amount of the clear ink is repeated continuously N times, where N is a positive integer satisfying $N > 1$.

* * * * *